US006039112A

United States Patent [19]

Ruppel et al.

[11] Patent Number: 6,039,112

[45] Date of Patent: Mar. 21, 2000

[54] PLATE-TYPE HEAT EXCHANGER AND METHOD OF MAKING SAME

[75] Inventors: Wolfgang Ruppel, Bad Wildbad; Guenther Schmalzried, Korb, both of Germany

[73] Assignee: Behr Industrietechnik GmbH & Co., Stuttgart, Germany

[21] Appl. No.: 09/033,076

[22] Filed: Mar. 2, 1998

[30] Foreign Application Priority Data

Mar. 8, 1997 [DE] Germany ..... 197 09 601

[51] Int. Cl.[7] ..... F28F 13/12; F28F 13/06

[52] U.S. Cl. ..... 165/109.1; 165/146; 165/166; 165/167; 165/916

[58] Field of Search ..... 165/109.1, 146, 165/166, 167, 916

[56] References Cited

U.S. PATENT DOCUMENTS

| | | | |
|---|---|---|---|
| 2,222,721 | 11/1940 | Ramsaur et al. | 165/916 X |
| 3,289,757 | 12/1966 | Rutledge | 165/166 |
| 3,322,189 | 5/1967 | Topouzian | 165/166 X |
| 3,537,513 | 11/1970 | Austin et al. | 165/70 |
| 3,866,674 | 2/1975 | Tramuta et al. | 165/166 |
| 4,049,051 | 9/1977 | Parker | 165/166 |
| 4,623,019 | 11/1986 | Wiard | 165/146 |
| 4,676,304 | 6/1987 | Koisuka et al. . | |
| 4,945,981 | 8/1990 | Joshi . | |

FOREIGN PATENT DOCUMENTS

| | | |
|---|---|---|
| 388446B | 6/1989 | Austria . |
| 0234942B1 | 5/1990 | European Pat. Off. . |
| 0611941A2 | 8/1994 | European Pat. Off. . |
| 0623798A2 | 11/1994 | European Pat. Off. . |
| 296 22 191 U 1 | 3/1997 | Germany . |

*Primary Examiner*—Allen Flanigan
*Attorney, Agent, or Firm*—Evenson, McKeown, Edwards & Lenahan, P.L.L.C.

[57] ABSTRACT

A plate-type heat exchanger for oil/coolant coolers on heat exchange media, as a rule, flow non-uniformly through known plate-type heat exchanger whose hollow chambers are provided with metal turbulence inserts because of the arrangement of these turbulence inserts. For increasing the heat exchange capacity, it is provided to divide the turbulence insert into sections in which a different alignment of rolled metal turbulence sheets takes place in each case. The sections are divided with respect to one another by separating cuts and, because of the different arrangement of their corrugations, have different flow resistances in sections for the flowing-through medium. As a result of this further development, it is possible to achieve a uniform flow in the hollow chambers.

16 Claims, 2 Drawing Sheets

PLATE-TYPE HEAT EXCHANGER AND METHOD OF MAKING SAME

BACKGROUND AND SUMMARY OF THE INVENTION

This application claims the priority of prior application 197 09 601.8 filed in Germany on Mar. 8, 1997, the disclosure of which is expressly incorporated by reference herein.

The invention relates to a plate-type heat exchanger, particularly an oil/coolant cooler, which comprises several plates which are arranged in parallel to one another and which form respective hollow chambers between one another which are provided with corrugated metal turbulence sheets for increasing the heat transfer and through which one of the respective media which participate in the heat transfer flows in an alternating manner.

A plate-type heat exchanger of this type is known from European Patent Document EP 06 23 798 A2, where trough-shaped heat exchanger plates were provided whose surrounding edges are placed against one another when the heat exchanger plates are stacked upon one another and which can then be tightly soldered to one another to form hollow chambers. In this case, each of the turbulence inserts inserted between the heat exchanger plates consists in a conventional manner of a thin metal sheet, preferably an aluminum sheet, which, in a rolling and cutting operation, was provided with a plurality of corrugations which are situated side-by-side and behind one another and which, viewed in the rolling direction, are arranged in different rows or are offset with respect to one another. These inserts are used for increasing the heat transfer capacity. However, when they are inserted between the inflow and outflow opening in their rolling direction or transversely to the rolling direction, they impair the pressure drop and the distribution of the media.

It is an object of the invention to construct a plate-type heat exchanger of the initially mentioned type such that a more uniform flow of the heat transfer media through the hollow chambers is achieved even when the metal turbulence sheets used for increasing the heat transfer are inserted.

For achieving this object, it is provided in the case of a plate-type heat exchanger of the initially mentioned type to divide the metal turbulence sheets into sections in which a different alignment exists of the course of the corrugations.

As a result of this measure, the flow can encounter different flow resistances in sections and it becomes possible in this manner to achieve an also largely uniform distribution of the heat transfer media in the individual hollow chambers despite the arrangement of the metal turbulence sheets. Deflection installations in the chambers through which the flow is forced may be eliminated. This also eliminates the expenditures for arranging such deflection walls inside the hollow chambers.

As a further development of the invention, in the case of turbulence metal sheets which were produced by rolling in the initially described manner, the desired alignment with respect to the rolling direction can simply be selected differently, and it was found to be particularly simple for the rolling direction in the sections to be in each case rotated by 90° with respect to that of the adjacent sections. Viewed from the inflow and outflow openings of the hollow chambers, this will result in sections with higher flow resistances and those with lower flow resistances, and the sections can be placed and designed such that the flowing medium is forced by the flow resistances to flow through the whole space of the hollow chamber in a flow which is as uniform as possible.

As a further development of the invention, the sections can be set off with respect to one another by separating cuts which may, for example, have defined contours or may be straight separating cuts. In a particularly simple manner, three sections can be formed by two diagonal cuts which are arranged mirror-symmetrically with respect to a transverse center plane which is symmetrically situated between the assigned inflow and outflow openings of the hollow chamber such that two outer sections, which have one inflow or outflow opening respectively, and an approximately trapezoidal center section are created.

As a further development of the invention, the diagonal sections can be arranged to be sloped at an angle of 30° with respect to the transverse center plane. In this case, the respective inflow or outflow opening is placed in the narrower area of the assigned outer section. In this embodiment, three different parts of the metal turbulence sheets respectively can then be placed in the hollow chambers.

Other objects, advantages and novel features of the present invention will become apparent from the following detailed description of the invention when considered in conjunction with the accompanying drawings.

DETAILED DESCRIPTION OF THE DRAWINGS

Figure 1:
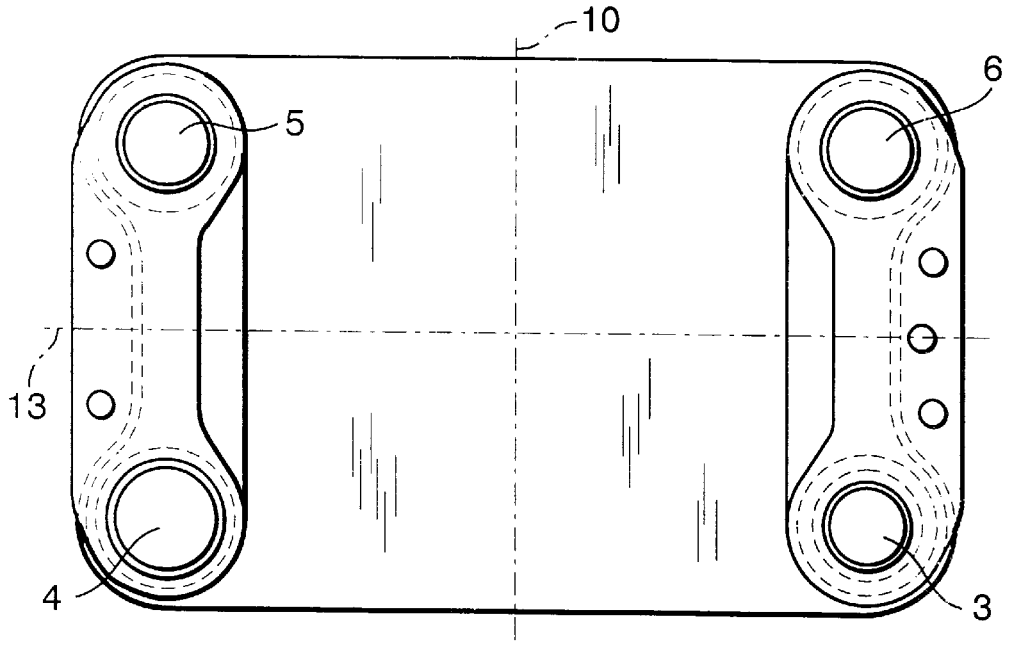
FIG. 1 is a top view of a plate-type heat exchanger constructed according to a preferred embodiment of the present invention.
Figure 2:
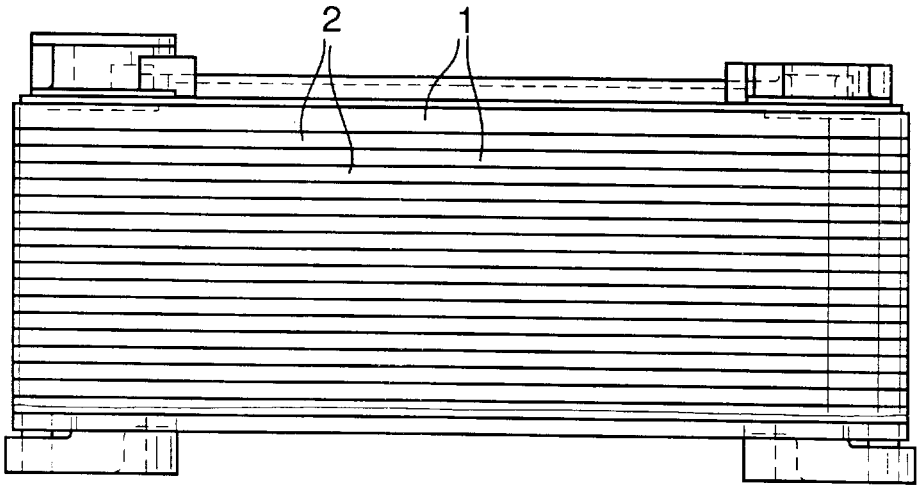
FIG. 2 is a lateral view of the plate-type heat exchanger of FIG. 1.

FIGS. 1 and 2 show an oil/coolant cooler for a motor vehicle engine in the case of which it is important to house a heat transfer capacity which is as large as possible in a space which is as small as possible. In this case, the oil cooler according to FIGS. 1 and 2 consists of several trough-shaped disks 1 and 2 which are stacked above one another and which form respective chambers between one another in a known manner through which the oil or the coolant to be cooled flows in a respective alternating manner, which coolant is taken, for example, from the coolant of the motor vehicle engine which is not shown.

In the case of the embodiment shown, the oil enters into a common connection piece 3 and leaves the cooler through the connection piece 4. Coolant enters through the connection piece 5 and leaves the cooler through the connection piece 6. In this case, the inflow and outflow connection pieces for the oil and the coolant may be arranged on the same side of the cooler body or on opposite sides. This does not change the flow through the individual hollow chambers which is important in the present case. The inflow and outflow openings for one medium are sealed off in the hollow chamber through which the other heat transfer medium flows by means of one inserted spacer disk respectively. In a modified embodiment, the spacer elements are a component of the disks 1 and/or 2 which are provided, for example, with set-off passages. The joint inflow connections 3 therefore supply several hollow chambers with oil in which the oil flows to the outflow connection 4. In the same manner, the inflow connection 5 in each case supplies the hollow chambers with coolant which adjoin the hollow chambers through which the oil flows, which coolant then flows out through the outflow connection piece 6.

Figure 3:
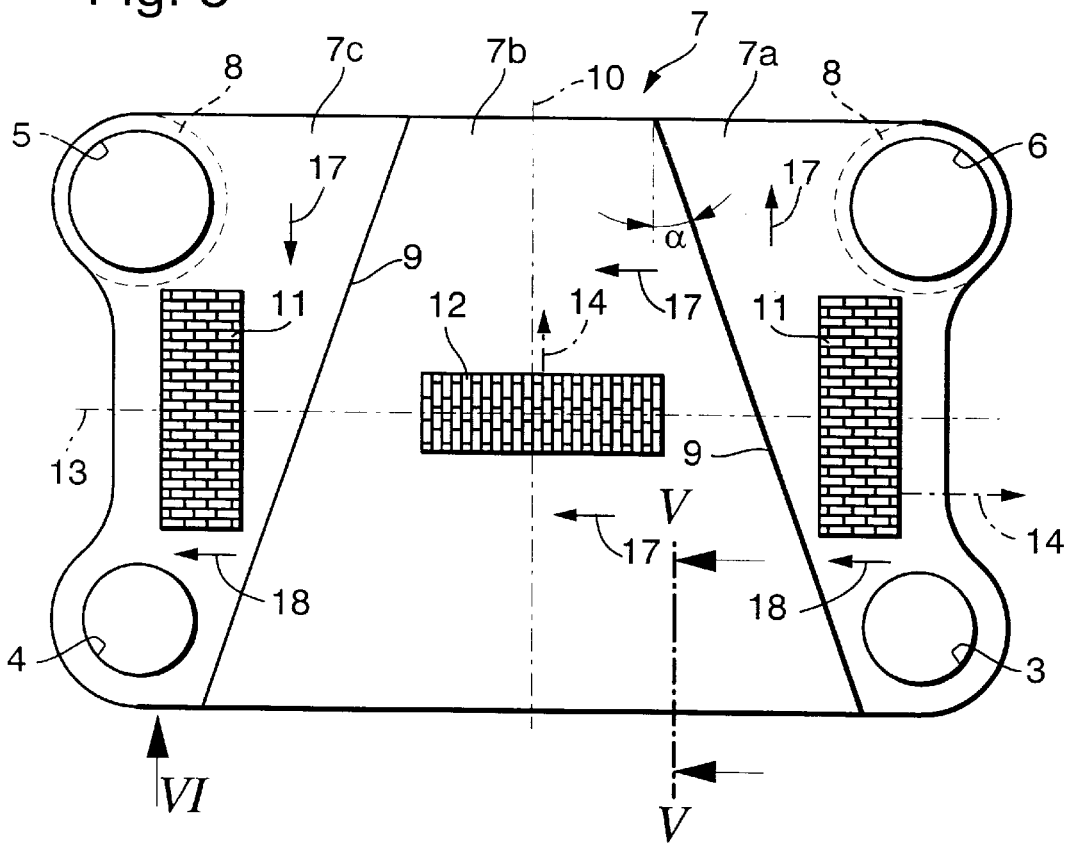
FIG. 3 is an enlarged schematic view depicting a turbulence insert arranged in the plate-type heat exchanger according to FIGS. 1 and 2 in one of the hollow chambers.
Figure 4:
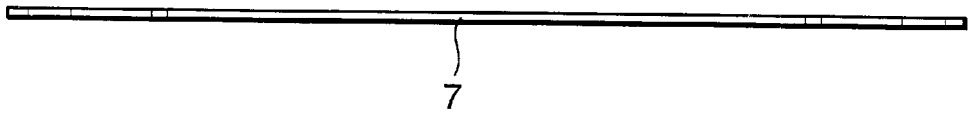
FIG. 4 is a lateral view of the turbulence insert of FIG. 3.

FIGS. 3 and 4 show a turbulence insert 7 which is arranged in one of the hollow chambers through which the oil flows. However, similar turbulence inserts are also provided in the chambers through which the coolant flows.

FIG. 3 therefore shows by means of broken lines that the inflow and outflow openings 5 and 6 for the coolant are sealed off by spacer disks 8 for the illustrated hollow chamber through which the oil flows. The oil therefore enters into the illustrated hollow chamber through the opening 3, flows through the turbulence insert in the hollow chamber and leaves the hollow chamber through the outflow connection 4.

Figure 6:
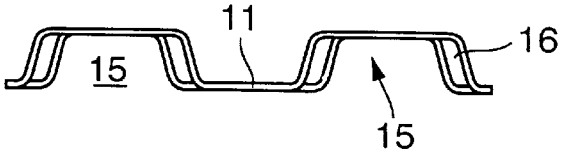
FIG. 6 is a view of another section of the turbulence insert of FIG. 3 taken in the direction of the arrow VI.

FIG. 3 shows that the turbulence insert 7 is divided into three sections 7*a*, 7*b*, and 7*c* which are each separated from one another by a respective diagonal cut 9 arranged sloped at an angle $\alpha$ of approximately 30° with respect to a transverse center plane 10 and symmetrically thereto. In section 7*a*, whose narrower side faces the inflow opening 3, a turbulence insert 11 is situated which corresponds to the shape of section 7*a*—only a rectangular shape portion is shown—whose rolling direction, like that of section 7*c*, is in parallel to a longitudinal center plane 13 and thus perpendicular to the transverse center plane 10. For a better understanding, the rolling directions are schematically indicated by respective dash-dotted line arrows 14. Transversely to the rolling direction, gate-type openings 15 (FIG. 6) are therefore created which, however, in adjacent rows, have different widths so that in a known manner respective slot-type openings 16 are created between adjacent gates, which slot-type openings 16 permit a flow not only transversely through the gates 15 but also in a direction perpendicularly thereto. However, it is clearly indicated that a flow in the direction of the gates, that is, a flow starting from the inflow opening 3 in the direction of the arrow 17 encounters little resistance to the flow, while a flow in the direction of the arrow 18 must overcome a much greater resistance because such a flow would have to take place exclusively through the slots 16. It therefore becomes clear that, in section 7*a*, because of the lower resistance, the flow from the inflow opening 3 can take place much more easily in the direction of the arrow 17 than in the direction of the arrow 18. The flow away from the opening 3 will therefore essentially also propagate in the direction of the arrow 17 while only a relatively small fraction of the flow will take place in the direction of the separating cut 9 (arrow 18).

Section 7*b* has a metal turbulence sheet arrangement which is rotated by 90° with respect to that of section 7*a*. In this case, the rolling direction 14 extends in parallel to the transverse center plane 10 which means that in this section 7*b*, the flow in the direction of the two arrows 17 must overcome relatively little resistance. However, since the center section 7*b* has a trapezoidal construction and has the largest width in its lower area, thus, in the area where the inflow and the outflow respectively is arranged in the adjacent sections 7*a* and 7*c*, the overall resistance of the flow in this section 7*a* will also be larger in the lower area than in the areas situated above. This has the result that the flow is distributed largely uniformly on section 7*b* since also the inflow from section 7*a* takes place largely uniformly by way of the separating cut 9.

In section 7*c*, the metal turbulence sheet 11 is in turn arranged analogously to that in section 7*a*. The flow in the direction of the arrow 18 is therefore also subject to a greater resistance than in the direction of arrow 17. The overall arrangement of the three sections 7*a*, 7*b* and 7*c* with the different alignment of the rolling direction 14 of the metal turbulence sheets in each case assigned to the sections therefore causes a uniform distribution of the flow in the hollow chamber without the requirement of separate separating walls or the like.

Figure 5:
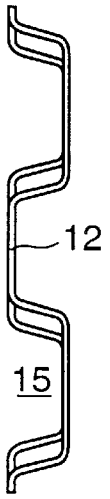
FIG. 5 is an enlarged view of a partial section of one of the sections of the turbulence insert of FIG. 3, taken along Line V—V of FIG. 3.

FIG. 5 shows that the gates 15 are rotated with their axes by 90° with respect to those of the gates of the metal turbulence sheets 11.

In the embodiment shown, three metal turbulence sheets in the shape of the sections 7*a*, 7*b* and 7*c* are separately placed into the assigned hollow chamber. These sections may also be connected with one another according to certain contemplated embodiments.

Depending on the method in which the flow is to be influenced, it is also contemplated to provide, instead of the straight separating cuts 9, also separating cuts in a curved shape by means of which an influencing of the flow can also be achieved according to the correspondingly constructed sections. Finally, it is also contemplated in certain embodiments to offset the rolling direction 14 in adjacent sections not by 90° but by other angles with respect to one another so that also in this manner, according to the desired flow pattern, a special influencing of the flow can be achieved.

FIGS. 3 and 4 show a chamber through which oil flows. The chamber through which the coolant flows is also equipped with metal turbulence sheets according to sections 7*a*, 7*b* and 7*c*. The flow of the coolant in the then formed sections from the inflow connection piece 5 to the outflow connection piece 6 is also influenced in the basically endeavored manner. However, since the coolant is much less viscous, slightly different aspects must be considered here during the distribution of the flow. However, it was found that the identical design of the metal turbulence sheets which was selected for the two hollow chambers (oil and coolant) causes the desired uniformity of the flow in all hollow chambers at low expenditures. Although a separate construction of the turbulence inserts or of the turbulence sections for the chambers through which the oil and the coolant flow would be possible according to contemplated embodiments, such arrangements would require much higher expenditures than the preferred embodiments with similar turbulence inserts.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Plate-type heat exchanger, comprising:

a plurality of plates which are arranged in parallel to one another and which form respective hollow chambers between one another, and said hollow chambers being free of deflection walls which define the overall pattern of flow between an inlet and an outlet, corrugated metal turbulence sheets disposed in the hollow chambers for increasing the heat transfer and through which one of the respective media which participate in the heat transfer flows in an alternating manner, wherein the metal turbulence sheets are divided into respective sections with different alignments of the course of the corrugations so that the one of the respective media encounters different flow resistances in said sections.

2. Plate-type heat exchanger according to claim 1, wherein said metal turbulence sheets are formed by rolling, and wherein the alignment with respect to a rolling direction forming the corrugation differs for the respective sections.

3. Plate-type heat exchanger according to claim 2, wherein the rolling direction in adjacent sections is in each case rotated by 90° with respect to that of an adjacent section.

4. Plate-type heat exchanger according to claim 1, wherein the sections are set off with respect to one another by separating cuts.

5. Plate-type heat exchanger according to claim 2, wherein the sections are set off with respect to one another by separating cuts.

6. Plate-type heat exchanger according to claim 3, wherein the sections are set off with respect to one another by separating cuts.

7. Plate-type heat exchanger according to claim 4, wherein three sections are provided, the three sections being separated by two diagonal separating cuts.

8. Plate-type heat exchanger according to claim 3, wherein three sections are provided, the three sections being separated by two diagonal separating cuts.

9. Plate-type heat exchanger, comprising:

a plurality of plates which are arranged in parallel to one another and which form respective hollow chambers between one another, and corrugated metal turbulence sheets disposed in the hollow chambers for increasing the heat transfer and through which one of the respective media which participate in the heat transfer flows in an alternating manner, wherein the metal turbulence sheets are divided into respective sections with different alignments of the course of the corrugations, wherein the sections are set off with respect to one another by separating cuts, wherein three sections are provided, the three sections being separated by two diagonal separating cuts, and wherein the diagonal separating cuts are arranged mirror-symmetrically with respect to a transverse center plane which is situated symmetrically between assigned inflow and outflow openings of the hollow chamber such that two outer sections with one inflow or outflow opening respectively as well as an approximately trapezoidal center section are created.

10. Plate-type heat exchanger, comprising:

a plurality of plates which are arranged in parallel to one another and which form respective hollow chambers between one another, and corrugated metal turbulence sheets disposed in the hollow chambers for increasing the heat transfer and through which one of the respective media which participate in the heat transfer flows in an alternating manner, wherein the metal turbulence sheets are divided into respective sections with different alignments of the course of the corrugations, wherein said metal turbulence sheets are formed by rolling, wherein the alignment with respect to a rolling direction forming the corrugation differs for the respective sections, wherein the rolling direction in adjacent sections is in each case rotated by 90° with respect to that of an adjacent section, wherein three sections are provided the three sections being separated by two diagonal separating cuts, and wherein the diagonal separating cuts are arranged mirror-symmetrically with respect to a transverse center plane which is situated symmetrically between assigned inflow and outflow openings of the hollow chamber such that two outer sections with one inflow or outflow opening respectively as well as an approximately trapezoidal center section are created.

11. Plate-type heat exchanger according to claim 9, wherein the diagonal cuts are arranged to be sloped approximately at an angle of 30° with respect to the transverse center plane.

12. Plate-type heat exchanger according to claim 10, wherein the diagonal cuts are arranged to be sloped approximately at an angle of 30° with respect to the transverse center plane.

13. Plate-type heat exchanger according to claim 11, wherein the respective inflow or outflow opening of one of the heat exchange media is situated in a narrower area of the assigned outer section while the respective inflow or outflow opening for the other heat exchange medium is situated in a wider area of the outer sections of the adjacent hollow chamber.

14. Plate-type heat exchanger according to claim 12, wherein the respective inflow or outflow opening of one of the heat exchange media is situated in a narrower area of the assigned outer section while the respective inflow or outflow opening for the other heat exchange medium is situated in a wider area of the outer sections of the adjacent hollow chamber.

15. Plate-type heat exchanger according to claim 1, wherein said respective media include oil and coolant.

16. Plate-type heat exchanger according to claim 15, wherein said oil is engine oil of a combustion engine.

* * * * *